US005082121A

United States Patent [19]

Grubb

[11] Patent Number: 5,082,121

[45] Date of Patent: Jan. 21, 1992

[54] PORTABLE HAT CADDY

[76] Inventor: Kenneth W. Grubb, 3505 E. 186th North, Skiatook, Okla. 74070

[21] Appl. No.: 696,882

[22] Filed: May 8, 1991

[51] Int. Cl.[5] ..... A47F 7/00

[52] U.S. Cl. ..... 211/33; 211/195; 248/164; 248/173

[58] Field of Search ..... 211/30, 33, 195, 203; 248/164, 166, 176, 431, 172, 173

[56] References Cited

U.S. PATENT DOCUMENTS

| | | | |
|---|---|---|---|
| 954,391 | 4/1910 | Heagany | 211/33 |
| 988,927 | 4/1911 | Canham | 211/33 X |
| 1,124,714 | 1/1915 | Denning | 211/33 |
| 4,757,905 | 7/1988 | Green | 211/31 |
| 4,763,865 | 8/1988 | Danner | 248/173 X |

FOREIGN PATENT DOCUMENTS

| | | | |
|---|---|---|---|
| 420079 | 1/1911 | France | 211/33 |

*Primary Examiner*—Robert W. Gibson, Jr.
*Attorney, Agent, or Firm*—Robert K. Rhea

[57] ABSTRACT

A hat caddy for holding a hat in substantial wearing position is formed by a pair of substantially L-shaped arm assemblies pivotally interconnected in crossed relation for pivoting movement of their respective end portions toward and away from each other. Hat crown and brim support ledges on cooperating ends of the arms support a hat in crown upright position while foot portions on the other ends of the arm assemblies maintain them in upright hat supporting relation. The hat caddy may be folded flat for travel or storage.

2 Claims, 1 Drawing Sheet

PORTABLE HAT CADDY

BACKGROUND OF THE INVENTION

1. Field of the Invention

This invention relates to a hat caddy and more particularly to a device for holding a hat in a position simulating the position on a person's head.

At present, many individuals wear wide brimmed, tall crown western style hats. It is preferred that such hats be properly supported when not being worn in order to maintain the configuration thereof.

Since most individuals for some time have not worn hats, a hat rack or place for supporting a hat has generally disappeared from hotels, motels and the like.

Further, the individual wearing a western style hat while traveling needs to provide a hat caddy in order to support his hat. The hat caddy preferably being capable of collapsing to a substantially planar position for carrying in a suitcase or the like. This invention provides such a hat caddy.

2. Description of the Prior Art

Hat racks or hat holders other than pole-like upright hat/coat racks have generally comprised a unitary length of wire arranged to form a partially surrounding crown portion in which the wire ends are attached to a vertical wall surface or the underside of a chair or bench for holding the hat in an inverted position.

Other examples of the prior is shown by U.S. Pat. No. 4,757,905 which features a frustoconical hat form partially entering the crown of a hat and includes a plurality of pivotally interconnected lever members for supporting the hat from a chair back, wall or on a flat surface.

This invention is distinctive over this patent and other prior art by providing a pair of crossed pivotally connected arms having brim and sweatband engaging lips at one end of each arm. The other end of each arm is provided with a foot portion supporting the hat in an elevated position with respect to a horizontal surface and in which the arms are pivotally adjustable for various size hats.

Summary of the Invention

A pair of substantially L-shaped arms are pivotally interconnected substantially medially their ends. One end portion of each of the arms is provided with hat brim and sweatband supporting lips. The foot portions of the respective L-shaped arm forms a support base for the caddy.

The arms may be pivoted from a crossed substantially X-shape, in side elevation, for supporting a hat thereon or collapsed to a substantially flat configuration no thicker than the transverse dimension of the respective arm for storage in baggage or the like.

The principal object of this invention is to provide a portable collapsible hat caddy which will support any type of hat or cap in substantially a wearing position and which may be collapsed or folded to a substantially flat configuration for storage or placing in baggage.

DESCRIPTION OF THE PREFERRED EMBODIMENTS

Figure 1:
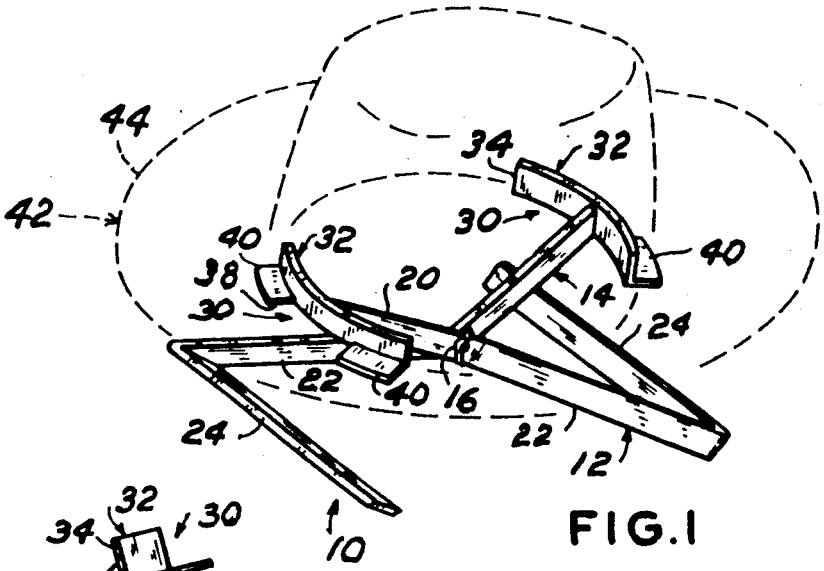
FIG. 1 is a perspective view of the device in hat holding position, the outline of a western style hat being shown by broken lines.

Like characters of reference designate like parts in those figures of the drawings in which they occur.

Figure 3:
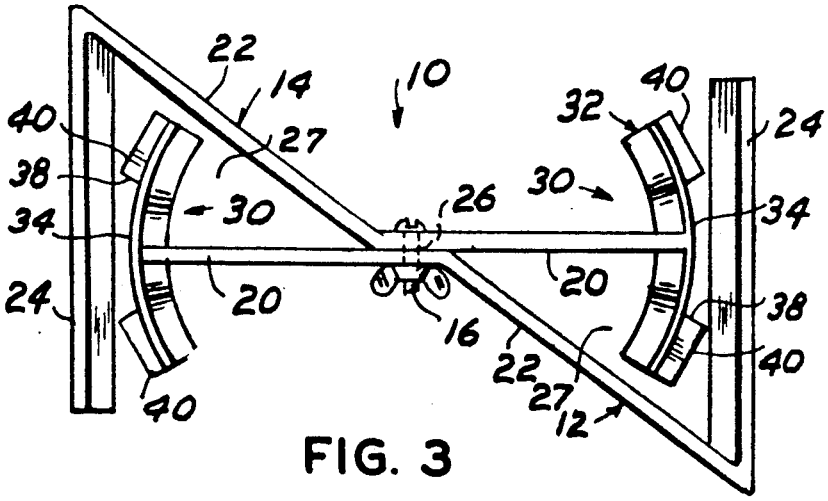
FIG. 3 is a top plan view of the device when folded to a flat configuration; and, FIG. 4 is a side elevational view of FIG. 3.

In the drawings:

The reference numeral 10 indicates the device as a whole comprising a pair of substantially L-shaped arms 12 and 14 when viewed in top plan view (FIG. 3).

Figure 2:
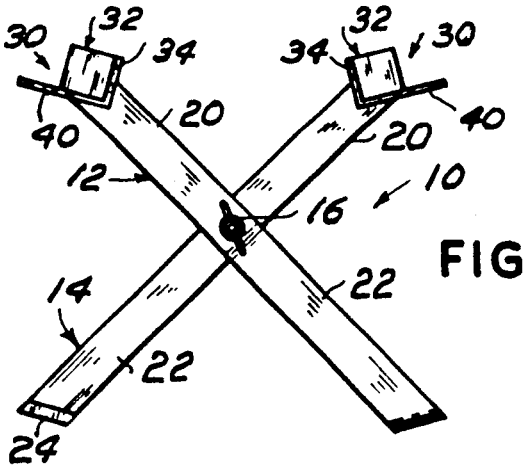
FIG. 2 is a side elevational view of the device to a larger scale, per se.

The arms 12 and 14 are pivotally connected substantially medially their ends by a bolt and thumb screw 16 for pivoting movement of their respective end portions about a horizontal axis formed by the bolt and thumb screw 16 when pivoted to a hat holding position. The arms 12 and 14 substantially describe an X when viewed in side elevation (FIG. 2).

Since the arms 12 and 14 are identical only the arm 12 is described in detail.

The L-shaped arm 12 is formed from a length of strap-like material having a leg characterized by a straight portion 20, an angular portion 22 and a foot portion 24 normal to the longitudinal axis of the straight portion 20.

The arm 12 is transversely apertured in the straight portion, as at 26, for receiving the bolt and thumb screw 16. The angular portion 22 and foot portion 24 form a "pocket" 27 nesting the straight portion of the opposite leg as presently explained.

The leg portions 20 and 22 are vertically disposed edgewise as viewed in FIG. 3, and the leg portion 24 is transversely angularly turned inwardly to dispose its lower longitudinal edge toward the opposite end of the leg on a selected angle A, (FIG. 4), substantially 60° in the example shown.

The length of the foot portion 24 is substantially greater than the length of the hat supporting ledge portion 30 at the opposite end of each leg.

The hat supporting ledge portion 30 comprises a length of right angular material 32 longitudinally arcuately curved on a radius, complemental with the conventional range of hat sizes for the purposes presently believed obvious.

Medially its ends the concave surface of the upstanding leg 34 of the angle member 32 is rigidly secured transversely to the end of the leg straight portion 20, opposite the foot portion 24 on an angle complemental with the angle A.

The medial portion of the other depending leg of the angle member 32 is cut away as at 38, defining a pair of lips 40 respectively disposed at the end portions of the respective arcuate angle member 32 for the purposes presently explained.

Operation

In operation the arms 12 and 14 are manually positioned in crossed relation, as illustrated by FIGS. 1 and 2, to dispose the hat supporting ledges 30 in selected spaced apart relation in accordance with the head size of a hat 42 to be supported thereby.

This positions the upstanding leg or flange 34 of the hat supporting ledges 30 substantially vertical with the respective lips 40 substantially disposed horizontally. The opposing upstanding convex surface of the arcuate angle member flange 34 thus contact or are disposed at least adjacent diametrically opposite portions of the hat sweatband, not shown, with the respective pairs of lips 40 underlying the adjacent edge portion of the hat brim 44 adjacent the sweatband, thus supporting the hat. An edge surface of the foot portion 24 of the respective leg is disposed on a supporting surface to support the hat.

Figure 4:
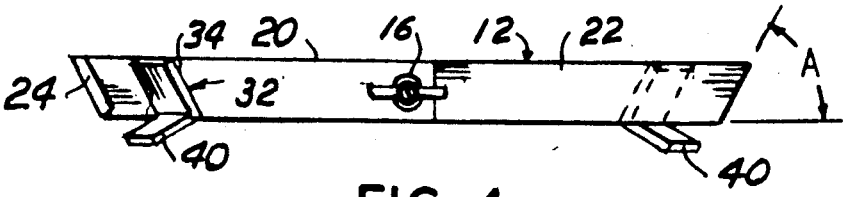

When the caddy 10 is to be moved for storage or travel, the screw 16 and thumb nut are loosened so that the arms leg portions 20 and hat support portions 30 pivot downward relative to the foot portions 24 and are nested by the pockets 27 adjacent the respective foot portion 24. The angle flanges 34 lie in the plane of foot portions 24 to form a flat configuration as illustrated by FIG. 4.

The thumb screw may be tightened in this configuration to prevent unauthorized movement of either of the arms 12 or 14.

Obviously the invention is susceptible to changes or alterations without defeating its practicability. Therefore, I do not wish to be confined to the preferred embodiment shown in the drawings and described herein.

I claim:

1. A hat caddy, comprising:

a pair of identical elongated arm assemblies pivotally interconnected substantially medially their ends for pivoting movement of their respective end portions toward and away from each other;

each said arm assembly being substantially L-shaped having a leg portion and a foot portion;

a hat crown and brim supporting means on cooperating ends of said arm assemblies for supporting a hat when disposed thereon in crown upright position; and, a foot portion on each arm assembly opposite the crown and brim supporting means for supporting the hat caddy upright on a horizontal surface, each said leg portion being characterized by substantially one-half its length laterally offset angularly with the foot portion with respect to the longitudinal axis of the remaining one-half leg portion to form a pocket nesting the crown and brim supporting means on the other arm assembly when said hat caddy arm assemblies are collapsed to a caddy stored or travel position.

2. The hat caddy according to claim 1 in which said supporting means comprises:

a right angular member having one flange of the right angle shape arcuately curved longitudinally complemental with an arc of a hat sweatband and having spaced-apart lips defined by the other flange of the right angle shape for underlying in supporting relation an intermediate portion of a hat brim when placed thereon.

* * * * *